US006604504B2

(12) United States Patent
Surnilla et al.

(10) Patent No.: US 6,604,504 B2
(45) Date of Patent: Aug. 12, 2003

(54) METHOD AND SYSTEM FOR TRANSITIONING BETWEEN LEAN AND STOICHIOMETRIC OPERATION OF A LEAN-BURN ENGINE

(75) Inventors: Gopichandra Surnilla, West Bloomfield, MI (US); David George Farmer, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/884,383

(22) Filed: Jun. 19, 2001

(65) Prior Publication Data

US 2002/0189580 A1 Dec. 19, 2002

(51) Int. Cl.[7] ..... F02B 17/00
(52) U.S. Cl. ..... 123/295; 123/443; 123/673
(58) Field of Search ..... 123/295, 443, 123/673, 691, 692

(56) References Cited

U.S. PATENT DOCUMENTS

| | | | |
|---|---|---|---|
| 3,696,618 | A | 10/1972 | Boyd et al. |
| 3,969,932 | A | 7/1976 | Rieger et al. |
| 4,033,122 | A | 7/1977 | Masaki et al. |
| 4,036,014 | A | 7/1977 | Ariga |
| 4,167,924 | A | 9/1979 | Carlson et al. |
| 4,178,883 | A | 12/1979 | Herth |
| 4,186,296 | A | 1/1980 | Crump, Jr. |
| 4,251,989 | A | 2/1981 | Norimatsu et al. |
| 4,533,900 | A | 8/1985 | Muhlberger et al. |
| 4,622,809 | A | 11/1986 | Abthoff et al. |
| 4,677,955 | A | 7/1987 | Takao |
| 4,854,123 | A | 8/1989 | Inoue et al. |
| 4,884,066 | A | 11/1989 | Miyata et al. |
| 4,913,122 | A | 4/1990 | Uchida et al. |
| 4,964,272 | A | 10/1990 | Kayanuma |
| 5,009,210 | A | 4/1991 | Nakagawa et al. |
| 5,088,281 | A | 2/1992 | Izutani et al. |
| 5,097,700 | A | 3/1992 | Nakane |
| 5,165,230 | A | 11/1992 | Kayanuma et al. |
| 5,174,111 | A | 12/1992 | Nomura et al. |
| 5,189,876 | A | 3/1993 | Hirota et al. |
| 5,201,802 | A | 4/1993 | Hirota et al. |
| 5,209,061 | A | 5/1993 | Takeshima |

(List continued on next page.)

FOREIGN PATENT DOCUMENTS

| | | |
|---|---|---|
| DE | 196 07 151 C1 | 7/1997 |
| EP | 0 351 197 A2 | 1/1990 |

(List continued on next page.)

OTHER PUBLICATIONS

C. D. De Boer et al., "Engineered Control Strategies for Improved Catalytic Control of $NO_x$ in Lean Burn Applications," SAE Technical Paper No. 881595, Oct. 10–13, 1988.

Y. Kaneko et al., "Effect of Air–Fuel Ratio Modulation on Conversion Efficiency of Three–Way Catalysts," SAE Technical Paper No. 780607, Jun. 5–9, 1978, pp. 119–127.

*Primary Examiner*—Erick Solis
(74) *Attorney, Agent, or Firm*—Julia Voutyras; Allan J. Lippa

(57) ABSTRACT

An exhaust treatment system for an internal combustion engine includes a catalytic emission control device. When transitioning the engine between a lean operating condition and a stoichiometric operating condition, as when scheduling a purge of the downstream device to thereby release an amount of a selected exhaust gas constituent, such as $NO_x$, that has been stored in the downstream device during the lean operating condition, the air-fuel ratio of the air-fuel mixture supplied to each cylinder is sequentially stepped from an air-fuel ratio of at least about 18 to the stoichiometric air-fuel ratio. The purge event is preferably commenced when all but one cylinders has been stepped to stoichiometric operation, with the air-fuel mixture supplied to the last cylinder being stepped immediately to an air-fuel ratio rich of a stoichiometric air-fuel ratio.

5 Claims, 2 Drawing Sheets

U.S. PATENT DOCUMENTS 5,222,471 A 6/1993 Stueven
5,233,830 A 8/1993 Takeshima et al.
5,267,439 A 12/1993 Raff et al.
5,270,024 A 12/1993 Kasahara et al.
5,272,871 A 12/1993 Oshima et al.
5,325,664 A 7/1994 Seki et al.
5,331,809 A 7/1994 Takeshima et al.
5,335,538 A 8/1994 Blischke et al.
5,357,750 A 10/1994 Ito et al.
5,359,852 A 11/1994 Curran et al.
5,377,484 A 1/1995 Shimizu
5,402,641 A 4/1995 Katoh et al.
5,410,873 A 5/1995 Tashiro
5,412,945 A 5/1995 Katoh et al.
5,412,946 A 5/1995 Oshima et al.
5,414,994 A 5/1995 Cullen et al.
5,419,122 A 5/1995 Tabe et al.
5,423,181 A 6/1995 Katoh et al.
5,426,934 A 6/1995 Hunt et al.
5,433,074 A 7/1995 Seto et al.
5,437,153 A 8/1995 Takeshima et al.
5,448,886 A 9/1995 Toyoda
5,448,887 A 9/1995 Takeshima
5,450,722 A 9/1995 Takeshima et al.
5,452,576 A 9/1995 Hamburg et al.
5,472,673 A 12/1995 Goto et al.
5,473,887 A 12/1995 Takeshima et al.
5,473,890 A 12/1995 Takeshima et al.
5,483,795 A 1/1996 Katoh et al.
5,531,972 A 7/1996 Rudy
5,544,482 A 8/1996 Matsumoto et al.
5,551,231 A 9/1996 Tanaka et al.
5,554,269 A 9/1996 Joseph et al.
5,569,848 A 10/1996 Sharp
5,577,382 A 11/1996 Kihara et al.
5,595,060 A 1/1997 Togai et al.
5,598,703 A 2/1997 Hamburg et al.
5,617,722 A 4/1997 Takaku
5,622,047 A 4/1997 Yamashita et al.
5,626,014 A 5/1997 Hepburn et al.
5,626,117 A 5/1997 Wright et al.
5,655,363 A 8/1997 Ito et al.
5,657,625 A 8/1997 Koga et al.
5,693,877 A 12/1997 Ohsuga et al.
5,713,199 A 2/1998 Takeshima et al.
5,715,679 A 2/1998 Asanuma et al.
5,722,236 A 3/1998 Cullen et al.
5,724,808 A 3/1998 Ito et al.
5,729,971 A 3/1998 Matsuno et al.
5,732,554 A 3/1998 Sasaki et al.
5,735,119 A 4/1998 Asanuma et al.
5,737,917 A 4/1998 Nagai
5,740,669 A 4/1998 Kinugasa et al.
5,743,084 A 4/1998 Hepburn
5,743,086 A 4/1998 Nagai
5,746,049 A 5/1998 Cullen et al.
5,746,052 A 5/1998 Kinugasa et al.
5,752,492 A 5/1998 Kato et al.
5,771,685 A 6/1998 Hepburn
5,771,686 A 6/1998 Pischinger et al.
5,778,666 A 7/1998 Cullen et al.
5,792,436 A 8/1998 Feeley et al.
5,802,843 A 9/1998 Kurihara et al.
5,803,048 A 9/1998 Yano et al.
5,806,306 A 9/1998 Okamoto et al.
5,813,387 A 9/1998 Minowa et al.
5,831,267 A 11/1998 Jack et al.
5,832,722 A 11/1998 Cullen et al.
5,842,339 A 12/1998 Bush et al.
5,842,340 A 12/1998 Bush et al.
5,862,661 A 1/1999 Zhang et al.
5,865,027 A 2/1999 Hanafusa et al.
5,867,983 A 2/1999 Otani
5,877,413 A 3/1999 Hamburg et al.
5,910,096 A 6/1999 Hepburn et al.
5,929,320 A 7/1999 Yoo
5,934,072 A 8/1999 Hirota et al.
5,938,715 A 8/1999 Zhang et al.
5,953,907 A 9/1999 Kato et al.
5,966,930 A 10/1999 Hatano et al.
5,970,707 A 10/1999 Sawada et al.
5,974,788 A 11/1999 Hepburn et al.
5,974,791 A 11/1999 Hirota et al.
5,974,793 A 11/1999 Kinugasa et al.
5,974,794 A 11/1999 Gotoh et al.
5,979,161 A 11/1999 Hanafusa et al.
5,979,404 A 11/1999 Minowa et al.
5,983,627 A 11/1999 Asik
5,992,142 A 11/1999 Pott
5,992,372 A * 11/1999 Nakajima ..... 123/295
5,996,338 A 12/1999 Hirota
6,003,308 A 12/1999 Tsutsumi et al.
6,012,282 A 1/2000 Kato et al.
6,012,428 A 1/2000 Yano et al.
6,014,859 A 1/2000 Yoshizaki et al.
6,023,929 A 2/2000 Ma
6,026,640 A 2/2000 Kato et al.
6,058,700 A 5/2000 Yamashita et al.
6,073,440 A 6/2000 Douta et al.
6,079,204 A 6/2000 Sun et al.
6,092,021 A 7/2000 Ehlbeck et al.
6,092,369 A 7/2000 Hosogai et al.
6,101,809 A 8/2000 Ishizuka et al.
6,102,019 A 8/2000 Brooks
6,105,365 A 8/2000 Deeba et al.
6,119,449 A 9/2000 Köhler
6,128,899 A 10/2000 Oono et al.
6,134,883 A 10/2000 Kato et al.
6,138,453 A 10/2000 Sawada et al.
6,145,302 A 11/2000 Zhang et al.
6,145,305 A 11/2000 Itou et al.
6,148,611 A 11/2000 Sato
6,148,612 A 11/2000 Yamashita et al.
6,161,378 A 12/2000 Hanaoka et al.
6,161,428 A 12/2000 Esteghlal et al.
6,164,064 A 12/2000 Pott
6,189,523 B1 2/2001 Weisbrod et al.
6,199,373 B1 3/2001 Hepburn et al.
6,202,406 B1 3/2001 Griffin et al.
6,205,773 B1 3/2001 Suzuki
6,214,207 B1 4/2001 Miyata et al.
6,216,448 B1 4/2001 Schnaibel et al.
6,216,451 B1 4/2001 Schnaibel et al.
6,233,923 B1 5/2001 Itou et al.
6,237,330 B1 5/2001 Takahashi et al.
6,244,046 B1 6/2001 Yamashita
6,324,835 B1 * 12/2001 Surnilla et al. ..... 123/443
6,360,713 B1 * 3/2002 Kolmanovsky et al. ..... 123/295
6,390,054 B1 * 5/2002 Yang ..... 123/295

FOREIGN PATENT DOCUMENTS

EP 0 444 783 A1 9/1991
EP 0 503 882 A1 9/1992
EP 0 580 389 A1 1/1994
GB 2316338 2/1998
GB 2355945 5/2001
JP 62-97630 5/1987
JP 62-117620 5/1987
JP 64-53042 3/1989
JP 2-30915 2/1990
JP 2-33408 2/1990

| | | |
|---|---|---|
| JP | 2-207159 | 8/1990 |
| JP | 5-26080 | 2/1993 |
| JP | 5-106493 | 4/1993 |
| JP | 5-106494 | 4/1993 |
| JP | 6-58139 | 3/1994 |
| JP | 6-264787 | 9/1994 |
| JP | 7-97941 | 4/1995 |
| WO | WO 98/27322 | 6/1998 |
| WO | 0118374 | 3/2001 |

OTHER PUBLICATIONS

W. H. Holl, "Air–Fuel Control to Reduce Emissions I. Engine–Emissions Relationships," SAE Technical Paper No. 800051, Feb. 25–29, 1980.

A. H. Meitzler, "Application of Exhaust–Gas–Oxygen Sensors to the Study of Storage Effects in Automotive Three–Way Catalysts," SAE Technical Paper No. 800019, Feb. 25–29, 1980.

J. Theis et al., "An Air/Fuel Algorithm to Improve the $NO_x$ Conversion of Copper–Based Catalysts," SAE Technical Paper No. 922251, Oct. 19–22, 1992.

W. Wang, "Air–Fuel Control to Reduce Emissions, II. Engine–Catalyst Characterization Under Cyclic Conditions," SAE Technical Paper No. 800052, Feb. 25–29, 1980.

T. Yamamoto et al., "Dynamic Behavior Analysis of Three Way Catalytic Reaction," JSAE 882072—882166.

* cited by examiner

METHOD AND SYSTEM FOR TRANSITIONING BETWEEN LEAN AND STOICHIOMETRIC OPERATION OF A LEAN-BURN ENGINE

BACKGROUND OF THE INVENTION

1. Technical Field

The invention relates to methods and systems for controlling transitions of a "lean burn" internal combustion engine between lean and stoichiometric engine operating conditions.

2. Background Art

Generally, the operation of a vehicle's internal combustion engine produces engine exhaust gas that includes a variety of constituents, including carbon monoxide (CO), hydrocarbons (HC), and nitrogen oxides ($NO_x$). The rates at which the engine generates these constituents are dependent upon a variety of factors, such as engine operating speed and load, engine temperature, spark timing, and EGR. Moreover, such engines often generate increased levels of one or more exhaust gas constituents, such as $NO_x$, when the engine is operated in a lean-burn cycle, i.e., when engine operation includes engine operating conditions characterized by a ratio of intake air to injected fuel that is greater than the stoichiometric air-fuel ratio (a "lean" engine operating condition), for example, to achieve greater vehicle fuel economy.

In order to control these vehicle tailpipe emissions, the prior art teaches vehicle exhaust treatment systems that employ one or more three-way catalysts, also referred to as emission control devices, in an exhaust passage to store and release select exhaust gas constituents, such as $NO_x$, depending upon engine operating conditions. For example, U.S. Pat. No. 5,437,153 teaches an emission control device which stores exhaust gas $NO_x$ when the exhaust gas is lean, and releases previously-stored $NO_x$ when the exhaust gas is either stoichiometric or "rich" of stoichiometric, i.e., when the ratio of intake air to injected fuel is at or below the stoichiometric air-fuel ratio. Such systems often employ open-loop control of device storage and release times (also respectively known as device "fill" and "purge" times) so as to maximize the benefits of increased fuel efficiency obtained through lean engine operation without concomitantly increasing tailpipe emissions as the device becomes "filled."

The timing of each purge event must be controlled so that the device does not otherwise exceed its $NO_x$ storage capacity, because the selected exhaust gas constituent would then pass through the device and effect an undesired increase in tailpipe emissions. The frequency of the purge is preferably controlled to avoid the purging of only partially filled devices, due to the fuel penalty associated with the purge event's enriched air-fuel mixture.

The prior art has recognized that the storage capacity of a given emission control device for a selected exhaust gas constituent is itself a function of many variables, including device temperature, device history, sulfation level, and the presence of any thermal damage to the device. Moreover, as the device approaches its maximum capacity, the prior art teaches that the incremental rate at which the device continues to store the selected exhaust gas constituent may begin to fall. Accordingly, U.S. Pat. No. 5,437,153 teaches use of a nominal $NO_x$-storage capacity for its disclosed device which is significantly less than the actual $NO_x$-storage capacity of the device, to thereby provide the device with a perfect instantaneous $NO_x$-retaining efficiency, that is, so that the device is able to store all engine-generated $NO_x$ as long as the cumulative stored $NO_x$ remains below this nominal capacity. A purge event is scheduled to rejuvenate the device whenever accumulated estimates of engine-generated $NO_x$ reach the device's nominal capacity.

Significantly, it has been observed that a gasoline-powered internal combustion engine is likely to generate increased levels of certain exhaust gas constituents, such as $NO_x$, when transitioning between a lean operating condition and a stoichiometric operating condition. For example, such engines are likely to generate increased levels of $NO_x$ as each of its cylinders are operated with an air-fuel ratio in the range between about 18 and about 15. Such increased levels of generated $NO_x$ during lean-to-stoichiometric transitions are likely to precipitate increased tailpipe $NO_x$ emissions, particularly when the subject transition immediately precedes a scheduled purge event, because of the trap's reduced instantaneous efficiency (i.e., the reduced instantaneous $NO_x$-retention rate) and/or a lack of available $NO_x$-storage capacity.

In response, U.S. Pat. No. 5,423,181 teaches a method for operating a lean-burn engine wherein the transition from a lean operating condition to operation about stoichiometry is characterized by a brief period during which the engine is operated with an enriched air-fuel mixture, i.e., using an air-fuel ratio that is rich of the stoichiometric air-fuel ratio. Under this approach, the excess hydrocarbons flowing through the trap as a result of this "rich pulse" reduce excess $NO_x$ being simultaneously released from the trap, thereby lowering overall tailpipe $NO_x$ emissions which might otherwise result from the lean-to-stoichiometric transition.

The inventors herein have recognized that what is still needed, however, is a method of transitioning the engine between a lean operating condition and a stoichiometric operating condition that is itself characterized by reduced levels of a selected engine-generated exhaust gas constituent, such as $NO_x$, whereby overall tailpipe emissions of a selected exhaust gas constituent may be advantageously further reduced.

SUMMARY OF THE INVENTION

In accordance with the invention, a method and system for transitioning an engine between a first operating condition and a second operating condition, wherein the first and second operating conditions are characterized by combustion, in each of a plurality of engine cylinders, of a supplied air-fuel mixture having a first and second air-fuel ratio, respectively, and wherein one of the first and second air-fuel ratios is significantly lean of a stoichiometric air-fuel ratio and the other of the first and second air-fuel ratios is an air-fuel ratio at or near stoichiometry (hereinafter "a stoichiometric air-fuel ratio"), the method comprising identifying at least two discrete sets of cylinders supplied with the air-fuel mixture at the first air-fuel ratio; and sequentially stepping the air-fuel ratio of the air-fuel mixture supplied to each set of cylinders from the first air-fuel ratio to the second air-fuel ratio, includes: identifying at least two discrete sets of cylinders operating at the first air-fuel ratio; and sequentially stepping the air-fuel ratio of the air-fuel mixture supplied to each set of cylinders between the first air-fuel ratio and the second air-fuel ratio. In this manner, the invention advantageously avoids operating any given cylinder in the range of air-fuel ratios likely to generate excessively large concentration of a selected exhaust gas constituent during such transitions from either a lean operating condition to a stoichiometric operating condition or a stoichiometric operating condition to a lean operating condition. By way of example only, where the selected constituent is $NO_x$, the range of air-fuel ratios likely to generate an excessive concentration of $NO_x$ is between about 18 and the stoichiometric air-fuel ratio.

In accordance with another feature of the invention, in a preferred embodiment, torque fluctuations resulting from the use of different air-fuel mixtures in the several cylinders during transition are minimized by retarding the spark to any set of cylinders operating with a stoichiometric air-fuel ratio until all cylinders are operating at either the first or second operating condition. Thus, when transitioning from a lean operating condition to a stoichiometric operating condition, each set of cylinders is sequentially stepped between operating at a lean air-fuel ratio and operating at a stoichiometric air-fuel ratio, with spark being simultaneously retarded as to each set of cylinders whose respective air-fuel mixtures have been stepped to the stoichiometric air-fuel ratio. Similarly, when transitioning from a stoichiometric operating condition to a lean operating condition, spark is initially retarded to all sets of cylinders (each of which is operating, prior to the transition, with a stoichiometric air-fuel ratio). Then, as the air-fuel mixture supplied to each set of cylinders is stepped to the lean air-fuel ratio, the spark to those cylinders is simultaneously advanced.

In accordance with another feature of the invention, after spark has been retarded to all sets of cylinders transitioned from a lean operating condition to a stoichiometric operating condition, and with all cylinders operating at the stoichiometric air-fuel ratio, spark is preferably slowly advanced while air mass flow rate is decreased, either under the direction of an electronic throttle control or the vehicle driver. The spark and air-flow adjustment upon reaching stoichiometric operation in all cylinders ensures maximum fuel economy with little additional perceived torque fluctuation by vehicle occupants.

In accordance with another feature of the invention, where the invention is used in combination with a downstream device that stores a selected exhaust gas constituent, such as $NO_x$, when the engine's air-fuel ratio is lean and releases previously-stored selected constituent when the engine is operated at an air-fuel ratio at or rich of the stoichiometric air-fuel ratio, the method preferably includes enriching the air-fuel mixture to a third air-fuel mixture supplied to at least one cylinder for a predetermined time, whereupon the trap is purged of stored amounts of the selected constituent. In a preferred embodiment, the air-fuel mixture supplied to the last set of cylinders being stepped from a lean air-fuel ratio to a stoichiometric air-fuel ratio is, instead, immediately stepped to a rich air-fuel ratio to begin the purge event. Where desired, the air-fuel mixture supplied to at least one other set of cylinders, each already operating with a stoichiometric air-fuel ratio, is simultaneously stepped to the rich air-fuel ratio. Upon completion of the purge event, the enriched air-fuel mixture supplied to each enriched set of cylinders is returned, again in a "step" fashion, to a stoichiometric air-fuel ratio.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
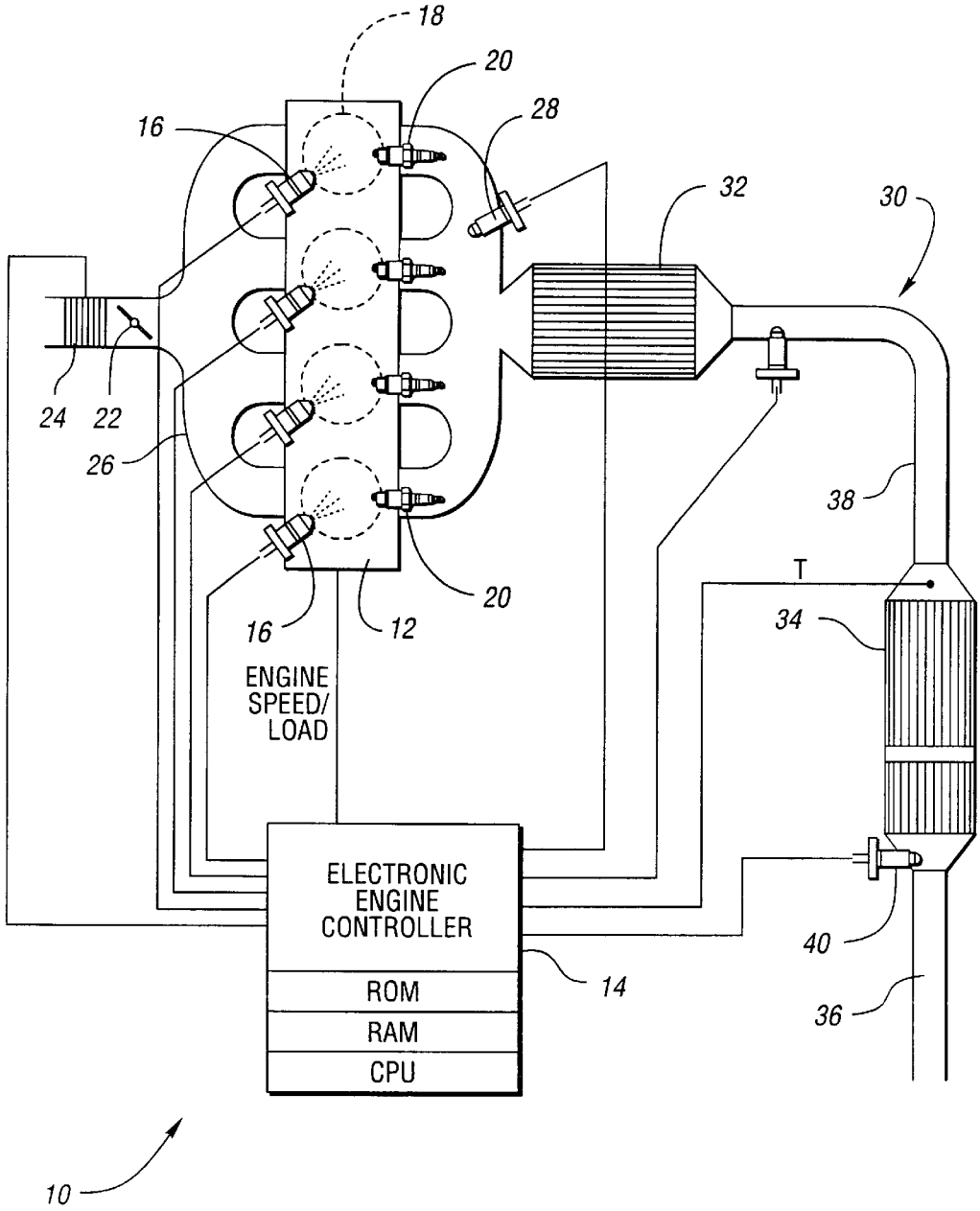
FIG. 1 is a schematic of an engine system for the preferred embodiment of the invention.

Referring to FIG. 1, an exemplary control system 10 for a four-cylinder, direct-injection, spark-ignition, gasoline-powered engine 12 for a motor vehicle includes an electronic engine controller 14 having ROM, RAM and a processor ("CPU") as indicated. The controller 14 controls the individual operation of each of a set of fuel injectors 16. The fuel injectors 16, which are of conventional design, are each positioned to inject fuel into a respective cylinder 18 of the engine 12 in precise quantities as determined by the controller 14. The controller 14 similarly controls the individual operation, i.e., timing, of the current directed through each of a set of spark plugs 20 in a known manner.

The controller 14 also controls an electronic throttle 22 that regulates the mass flow of air into the engine 12. During operation of the engine 12, the controller 14 transmits a control signal to the electronic throttle 22 and to each fuel injector 16 to maintain a target cylinder air-fuel ratio for the resulting air-fuel mixture individually supplied to each cylinder 18. An air mass flow sensor 24, positioned at the air intake of engine's intake manifold 26, provides a signal regarding the air mass flow resulting from positioning of the engine's throttle 22. The airflow signal from the air mass flow sensor 24 is utilized by the controller 14 to calculate an air mass value which is indicative of a mass of air flowing per unit time into the engine's induction system.

A heated exhaust gas oxygen (HEGO) sensor 28 detects the oxygen content of the exhaust gas generated by the engine and transmits a signal to the controller 14. The HEGO sensor 28 is used for control of the engine air-fuel ratio, especially during operation of the engine 12 at or near the stoichiometric air-fuel ratio which, for a constructed embodiment, is about 14.65. A plurality of other sensors (not shown) also generate additional electrical signals in response to various engine operations, for use by the controller 14.

An exhaust system 30 transports exhaust gas produced from combustion of an air-fuel mixture in each cylinder 18 through a pair of emission control devices 32,34.

Figure 2:
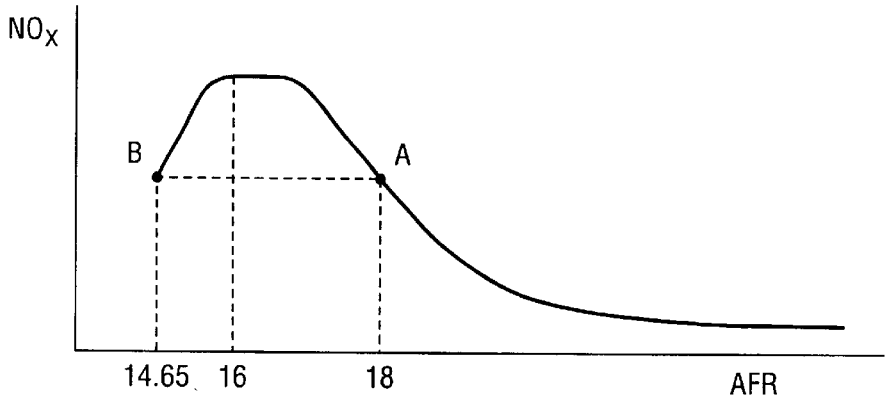
FIG. 2 is graph illustrating a typical concentration of a selected exhaust gas constituent, specifically, $NO_x$, in the engine feedgas over a range of air-fuel ratios.

As illustrated in FIG. 2, the concentration of a selected constituent of the exhaust gas generated by any given cylinder 18, such as $NO_x$, is a function of the in-cylinder air-fuel ratio (designated "AIR-FUEL RATIO" in FIG. 2). In accordance with the invention, the controller 14 regulates the air-fuel ratio of the air-fuel mixture supplied to each set of cylinders 18 to avoid cylinder operation at air-fuel ratios between about 18 and about 15 (the latter being slightly lean of the stoichiometric air-fuel ratio of 14.65), even when transitioning between a lean operating condition and a stoichiometric operating condition.

Figure 3:
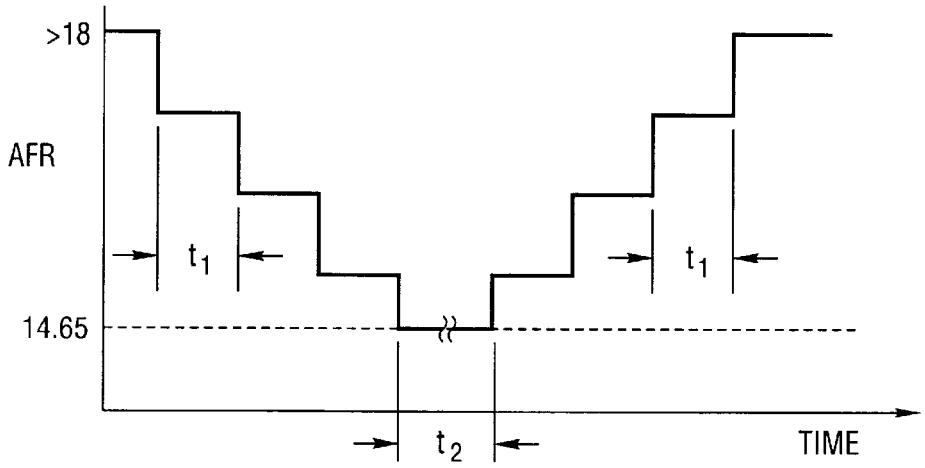
FIG. 3 is an expanded timing diagram illustrating a pair of transitions between a lean operating condition and a stoichiometric operating condition.

More specifically, under the invention, the controller 14 avoids such increased $NO_x$ emissions at the source by sequentially stepping, i.e., changing in a "step" fashion, the air-fuel ratio of the air-fuel mixture supplied to each of a plurality of discrete groups or sets of cylinders 18 (in the illustrated embodiment, there are four discrete sets of cylinders 18, one cylinder 18 to each set) between a lean air-fuel ratio of at least about 18 (illustrated as point A in FIG. 2) and a stoichiometric air-fuel ratio of about 15 (illustrated as point B in FIG. 2). Exemplary transitions from lean-to-stoichiometric operation and from stoichiometric-to-lean operation, as achieved by the proposed system, is illustrated in FIG. 3 (wherein each of the four sets includes a single cylinder 18). In this manner, the invention avoids operating of any given cylinder 18 in the range of problematic air-fuel ratios.

In order to minimize torque fluctuations when transitioning from a lean operating condition to a stoichiometric operating condition, or when transitioning from a stoichiometric operating condition to a lean operating condition, the controller 14 retards the spark to any cylinder 18/set of cylinders 18 which is operating, during transition, with a stoichiometric air-fuel ratio. More specifically, because any cylinder 18 operating with a stoichiometric air-fuel ratio will generate greater torque than another cylinder 18 operating "lean," spark is retarded in only the stoichiometric cylinders 18 to thereby even-out generated torque until all cylinders have been brought either to lean or stoichiometric operation.

Thus, when transitioning from a lean operating condition to a stoichiometric operating condition, each cylinder 18 is sequentially stepped between operating at a lean air-fuel ratio and operating at a stoichiometric air-fuel ratio, with spark being simultaneously retarded as to each cylinder whose respective air-fuel mixtures have been stepped to the stoichiometric air-fuel ratio. Similarly, when transitioning from a stoichiometric operating condition to a lean operating condition, spark is initially retarded to all cylinders 18 (each of which is operating, prior to the transition, with a stoichiometric air-fuel ratio). Then, as the air-fuel mixture supplied to each cylinder 18 is stepped to the lean air-fuel ratio, the spark to the cylinder 18 is simultaneously advanced.

In accordance with another feature of the invention, after spark has been retarded to all cylinders 18 transitioned from a lean operating condition to a stoichiometric operating condition, and with all cylinders 18 operating at the stoichiometric air-fuel ratio, spark is preferably slowly advanced over a predetermined time period $t_2$ while air mass flow rate is decreased, either under the direction of an electronic throttle 22 or the vehicle driver. The adjustment of spark and mass airflow during time period $t_2$ ensures maximum fuel economy with little additional perceived torque fluctuation by vehicle occupants after the cylinders 18 have been respectively brought to stoichiometric operation.

In accordance with the invention, the relative timing of the step change in air-fuel ratios of the several cylinders 18 is controlled by the controller 14. Where the engine features injection of fuel directly into each cylinder 18, changes in cylinder air-fuel ratios are immediate, and there need be a delay or "waiting period $t_1$"of only one cylinder event between the stepping of one set of cylinders 18 and the stepping of another set of cylinders 18. Where the engine features port fuel injection, a longer delay may be necessary so as to ensure that each stepped cylinder 18 has achieved the target air-fuel ratio. It will be appreciated that the controller 14 can alternatively calculate the waiting period $t_1$ in any suitable manner, for example, as a function of engine operating conditions such as engine load and speed, as through use of a lookup table stored in the controller's memory.

As seen in FIG. 3, the step change in the last set of cylinders 18 to either the lean operating condition or the stoichiometric operating condition is preferably followed by a waiting period $t_2$ during which the electronic throttle 22 adjusts the mass airflow into the engine 12, or the vehicle driver is otherwise permitted to respond by releasing the accelerator pedal (not shown) by a small amount, while the spark is advanced back to optimal. In this manner, a constant engine torque output is achieved.

Figure 4:
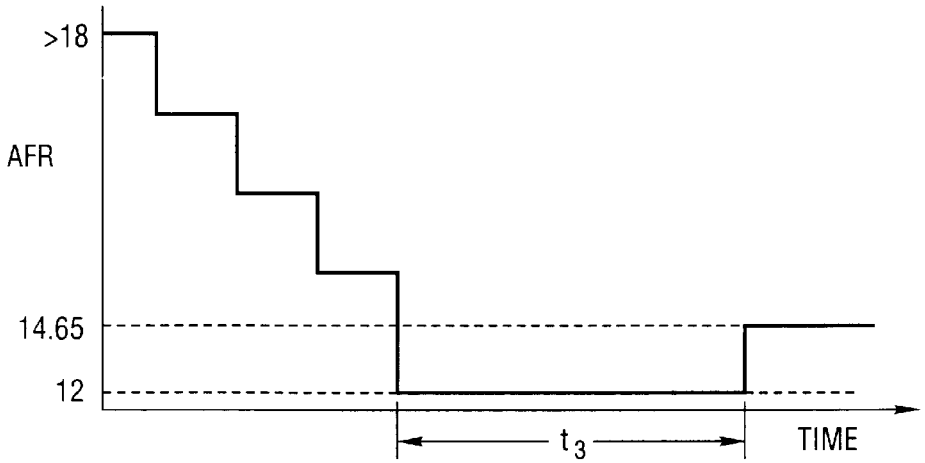
FIG. 4 is an expanded timing diagram illustrating a transition from a lean operating condition, through stoichiometric operation, and immediately into a scheduled purge event.

In accordance with another feature of the invention, the method is preferably also employed when transitioning from a lean engine operating condition to an enriched engine operating condition suitable for "purging" $NO_x$ stored in the trap 34, because of the trap's reduced instantaneous efficiency (i.e., the reduced instantaneous $NO_x$-absorption rate) and/or a lack of available $NO_x$-storage capacity in the trap 34 which triggered the need for the purge in the first instance. Still further, the last set of cylinders 18 to be stepped to stoichiometric operation is preferably immediately stepped through stoichiometric operation to rich operation, thereby immediately commencing the purge event, as illustrated in FIG. 4. Of course, the invention contemplates simultaneously switching other cylinders 18/sets of cylinders 18, then operating at the stoichiometric air-fuel ratio, to the enriched operating condition to thereby enhance the "strength" of the purge event. It will be appreciated that the purge time $t_3$, the relative degree to which the at least one cylinder 18 is enriched during the purge, and the number of cylinders 18 operated at an enriched air-fuel ratio, are each a function of the properties of the trap. The enriched operating condition is thereafter maintained for a predetermined "purge time $t_3$." At the end of the purge event, the air-fuel mixture at which each cylinder 18 is operated is nominally returned to the stoichiometric air-fuel ratio.

Alternatively, under the invention, the controller 14 may enrich the air-fuel ratio of the air-fuel mixture supplied to one or more cylinder 18 after bringing the last set of cylinder 18 to stoichiometric operation, and after expiration of a suitable predetermined time period $t_2$.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. For example, while the use of spark timing to normalize torque output during transition has been disclosed, it will be appreciated that the invention contemplates use of other suitable mechanism for controlling the torque output of the several cylinders 18 during transition, including any suitable mechanism for varying mass airflow to each individual cylinder 18.

What is claimed:

1. A method for transitioning an internal combustion engine between a first operating condition and a second operating condition, wherein the first and second operating conditions are characterized by combustion, in each of a plurality of engine cylinders, of a supplied air-fuel mixture having a first and second air-fuel ratio, respectively, and wherein one of the first and second air-fuel ratios is significantly lean of a stoichiometric air-fuel ratio and the other of the first and second air-fuel ratios is a stoichiometric air-fuel ratio, the method comprising:

identifying at least two discrete sets of cylinders supplied with the air-fuel mixture at the first air-fuel ratio;

sequentially stepping the air-fuel ratio of the air-fuel mixture supplied to each set of cylinders from the first air-fuel ratio to the second air-fuel ratio; and including retarding the timing of combustion ignition in one set of cylinders with respect to another set of cylinders until all sets of cylinders are operating at the second operating condition; and including decreasing a mass flow of air to all sets of cylinders simultaneous with advancing timing.

2. A method for transitioning an internal combustion engine between a first operating condition and a second operating condition, wherein the first and second operating conditions are characterized by combustion, in each of a plurality of engine cylinders, of a supplied air-fuel mixture having a first and second air-fuel ratio, respectively, and wherein one of the first and second air-fuel ratios is significantly lean of a stoichiometric air-fuel ratio and the other of the first and second air-fuel ratios is a stoichiometric air-fuel ratio, the method comprising:

identifying at least two discrete sets of cylinders supplied with the air-fuel mixture at the first air-fuel ratio;

sequentially stepping the air-fuel ratio of the air-fuel mixture supplied to each set of cylinders from the first air-fuel ratio to the second air-fuel ratio; and wherein the first air-fuel ratio is the lean air-fuel ratio and the second air-fuel ratio is the stoichiometric air-fuel ratio, the method further including:

determining when the air-fuel ratio of the air-fuel mixture supplied to all but one set of cylinders has been stepped to the second air-fuel ratio; and stepping the air-fuel ratio of the air-fuel mixture supplied to the one set of cylinders to a third air-fuel ratio rich of a stoichiometric air-fuel ratio.

3. The method of claim 2, wherein the third air-fuel ratio is maintained in the one set of cylinders for a third predetermined time, and further including changing the air-fuel ratio of the air-fuel mixture supplied to the one set of cylinders back to the second air-fuel ratio.

4. A system for controlling operation of a lean burn engine having a plurality of cylinders, each cylinder receiving a metered quantity of fuel from a respective fuel injector, and each cylinder receiving an ignition spark from a respective spark plug, the system comprising:

a controller including a microprocessor arranged to operate the fuel injector for each cylinder to thereby individually control the air-fuel ratio of an air-fuel mixture supplied to each cylinder, wherein the controller is further arranged to transitioning the engine between a first operating condition and a second operating condition, the first operating condition being characterized by a first air-fuel ratio and second operating conditions being characterized by a second air-fuel ratio, one of the first and second air-fuel ratios being significantly lean of a stoichiometric air-fuel ratio and the other of the first and second air-fuel ratios being a stoichiometric air-fuel ratio; and wherein the controller is arranged to sequentially step the air-fuel ratio of the air-fuel mixture supplied to each of at least two cylinders from the first air-fuel ratio to the second air-fuel ratio; and wherein the controller is further arranged to determine when the air-fuel mixture supplied to each cylinder has been maintained at the second air-fuel ratio for a second predetermined time, and to change the air-fuel ratio of the air-fuel mixture supplied to at least one cylinder to a third air-fuel ratio rich of the stoichiometric air-fuel ratio.

5. The system of claim 4, wherein the controller is further arranged to maintain the third air-fuel ratio in the at least one cylinder for a third predetermined time.

* * * * *